United States Patent [19]

Sako et al.

[11] Patent Number: 4,783,224

[45] Date of Patent: Nov. 8, 1988

[54] METHOD FOR HYDROPHILIC TREATMENT OF ALUMINUM USING AN AMPHOTERIC POLYMER

[75] Inventors: Ryosuke Sako, Hiratsuka; Takao Ogino, Yokohama; Motoki Kanazawa, Kanagawa; Akira Nishihara, Yokohama; Hiroshi Okita, Kanagawa; Yoshinori Sakamoto, Sakai, all of Japan

[73] Assignee: Nihon Parkerizing Co., Ltd., Tokyo, Japan

[21] Appl. No.: 132,243

[22] Filed: Dec. 14, 1987

[30] Foreign Application Priority Data

Dec. 29, 1986 [JP] Japan ..... 61-315818

[51] Int. Cl.[4] ..... F28F 13/18

[52] U.S. Cl. ..... 148/6.27; 427/388.2; 427/388.4; 427/409; 148/6.2

[58] Field of Search ..... 148/6.27, 6.2; 427/388.2, 388.1, 409

[56] References Cited

U.S. PATENT DOCUMENTS

| | | | |
|---|---|---|---|
| 4,136,073 | 1/1977 | Muro | 148/6.27 |
| 4,656,211 | 4/1987 | Nasu | 427/388.2 |

FOREIGN PATENT DOCUMENTS

| | | | |
|---|---|---|---|
| 0119782 | 9/1981 | Japan | 148/6.27 |
| 1099679 | 5/1986 | Japan | 148/6.27 |
| 1227877 | 10/1986 | Japan | 427/388.2 |

*Primary Examiner*—Sam Silverberg

*Attorney, Agent, or Firm*—Ernest G. Szoke; Wayne C. Jaeschke; Real J. Grandmaison

[57] ABSTRACT

A hydrophilic coating is formed on an aluminum surface by the application of an aqueous solution of an amphoteric acrylamide polymer which is dried in place. The polymer solution may contain a cross-linking agent and the dried coating may be subsequently treated to form a water-glass coating.

9 Claims, No Drawings

METHOD FOR HYDROPHILIC TREATMENT OF ALUMINUM USING AN AMPHOTERIC POLYMER

BACKGROUND OF THE INVENTION

The present invention concerns a method for the hydrophilic treatment of an aluminum surface. More specifically, it concerns a method for hydrophilic treatment of the surface of the heat transfer fins of aluminum heat exchangers.

In the past technology for the surface treatment of heat exchangers made of aluminum or aluminum alloy (hereinunder referred to as (aluminum)) for the purpose of preventing white rust development, employed anodic oxidation coating, Boehmite coating, resin treatment etc. However, the coating formed by such methods provide the surface with almost no water wettability. For the purpose of preventing white rust development, chromate conversion coating is also used in practice, which also gives water wettability but to a slight extend and only for a short period after the formation of coating. Therefore, chromating alone cannot provide sufficient hydrophilic quality. Further, a chromate conversion coating has a tendency to lose its hydrophilic property as time passes, particularly under heating/drying conditions. Therefore, chromate coating for the surface treatment of heat-exchanger fins is not satisfactory.

It is of course, desirable that the efficiency of heat radiation/cooling of the heat exchanger be as high as possible. For this purpose, the radiation and cooling parts are designed to have as large a surface area as posasible for the majority of cases and consequently the interfin distance is made extremely narrow. This causes atmospheric moisture to condense on the surface of the heat exchanger when used for cooling, particularly at the interfin spaces. Water thus condensed forms water droplets to a greater and greater extent the more hydrophobic the fin surface is. Such water droplets fill up the interfin spaces resulting in increased air flow resistance and the heat exchange efficiency is thereby reduced.

Moreover, due to the air flow, water droplets in the interfin spaces are subject to spattering the area around the heat exchanger.

Various methods have been proposed for the purpose of preventing water droplets from forming at interfin spaces. Treatment of the surface with a silicate such as water glass is effective for improving the water wettability and heat resistance with low cost, in view of which a number of methods have been proposed.

In summary, the methods hitherto used involving both inorganic and organic compounds for coating formation can be classified as follows:

a: Phosphate treated aluminum surface is processed directly with aqueous silicate coating and then dried. This method is exemplified by the Japanese Laid-Open Patent Sho No. 50-38645 (1975).

b: This method is exemplified by the Japanese Laid-Open Patent Sho No. 60-221582 (1985) which discloses that a hydrophilic inorganic coating comprising silicate, Beohmite etc. is formed on the aluminum sheet, over which a hydrophilic organic polymer having a ratio of polymerization more than 50 is coated.

c: The aluminum surface treated with an organic polymer coating is followed by silicate liquid coating and drying, one example of which is described in Japanese Laid-Open Patent Sho No. 59-205596 (1984) which discloses a fin material where aluminum sheet is coated with an organic resin film having corrosion resistance over which a hydrophilic coating consisting of silicates such as silica sol, silicic acid and water glass is formed.

d: The aluminum surface is coated with a mixture of organic polymer and inorganic silicate. This is exemplified by the following Laid-Open patents.

Japanese Laid-Open Patent Sho No. 61-8593 (1986) discloses a fin material which is coated with a mixture consisting of styrene/maleic acid copolymer, polyacrylamide, butylene/maleic acid copolymer, polyacrylic acid or their salts and silicates as represented by $xM_2.ySiO_2$ ($M=Li$, Na or K, $y/x \geqq 2$). Japanese Laid-Open Patent Sho No. 60-101156 (1985) discloses a chemical for forming hydrophilic coating on aluminum which contains alkali silicate and carbonyl compounds (aldehyde, esters, amides etc.).

With regard to other conventional methods that use organic compounds for the hydrophilic treatment of aluminum, Japanese Laid-Open Patent Sho No. 59-205596 discloses a method of using an organic solvent. Organic compounds disclosed therein are acrylic resins, epoxy base resins, urethane base resins, vinyl type resins such as polyvinyl chloride-vinyl acetate, polyethylene, polypropylene and the like, stylol base resins, phenolic resins, fluororesins, silicone resins, diaryl phthalate resins, polycarbonate resins, polyamide resins, alkyd resins, polyester resins, urea melamine resins, polyacetal resins, cellulose resins etc. These compounds may be combined with an organic solvent. On the other hand, the abovementioned Laid-Open Sho No. 60-101156 describes low molecular organic compounds having the carbonyl group (e.g. glyoxal) together with a water-soluble organic polymer (e.g. copolymer of acrylamide and acrylic acid) diluted with water and used for coating aluminum followed by heating and drying.

The past technologies which use polyacrylamide as an organic compound for hydrophilic treatment have been further reviewed.

As described in Japanese Laid-Open Patents Sho No. 61-101156 and Sho No. 61-8598, the use of a polyacrylamide as a chemical for hydrophilic treatment is known. Such compound can be uniformly mixed in water when the content is low. However, with increasing concentration caused during the drying process, the alkali silicate and polymer become separated into two phases, often resulting in nonreproducibility of the quality. This is a major drawback.

Japanese Laid-Open Patent Sho NO. 60-221582 proposes a method that, over the film of a hydrophilic inorganic coating, polyacrylamide as hydrophilic organic coating former is applied wherein the degree of polymerization is adjusted so that solvent degreasing of press oil used for press working can be done with ease and the organic polymer layer remaining after degreasing can serve to fill pinholes of the inorganic coating. According to this patent, further, a cross-linking agent consisting of compounds of Zr, Ti etc. can provide said polyacrylamide with cross-linking of hydrophilic group in a range that such group is not entirely all cross-linked. According to said patent, the hydrophilic coating remaining as a final coating after solvent cleaning is a layer of inorganic, hydrophilic coating obtained by silicate treatment or Boehmite treatment as the undermost layer.

The first category (a) of conventional methods for hydrophilic film formation, provides the coating with a hydrophilic property but not with corrosion resistance. For this reason, such coating formation may lead on the contrary to degraded corrosion resistance and exhibits a disadvantage that white rust tends to occur.

In the case of the second category (b) of conventional methods for hydrophilic treatment, the hydrophilic property is mainly given by the organic components such as Boehmite and silicate. The main purpose of the organic coating is to prevent the abovementioned inorganic coating for being contaminated with press oil and thereby being made water repellent; after having performed this role, such organic coating is removed together with press oil in the subsequent degreasing stage. As a result, the performance is not satisfactory in the corrosion resistance nor in the hydrophilicity.

The third category (c) is satisfactory for corrosion resistance and for the hydrophilic performance during the incipient period, its disadvantage being, however, that the silicate of the top layer tends to be washed away as water condenses on the surface during operation resulting in degradation of the hydrophilic property.

In the fourth category (d), since silicate is contained in the coating it tends to be washed away and the fin treated with such method has a tendency to increasingly undergo white rusting. Further, the drying stage may cause the silicate and the organic polymer to separate into different layers and as a result the performance becomes variable largely depending on manufacture conditions, and in many cases the fin thereby treated exhibits insufficient hydrophilicity.

The method of Japanese Laid-Open Patent Sho No. 59-205596 uses an organic polymer coating having resistance to water and corrosion as the base coating. Since this method uses organic solvent in many cases, problems arise from fire hazard and environmental safety as well as from the low hydrophilicity of the thereby formed base film, which makes it difficult to use aqueous water-glass solution for forming a thin and uniform top coat over the base coat.

It is notable here than the method of Japanese Laid-Open Patent Sho No. 60-221582 where polyacrylamide etc. are also described should be regarded as equivalent to the conventional technology classified into the first category in regard to the way of constituting the coating layer for the reason that polyacrylamide does not remain on the fin to any significant extent, meaning that no suggestion is made of using water-soluble organic polymer like polyacrylamide as a permanent coating of the fin.

The inventors hypothesized that a single layer of organic polymer that constitutes the coating, provided that the coating thus formed be given sufficient corrosion resistance and hydrophilicity (including durability resistance to running water) might be capable of overcoming the disadvantages mentioned in the first category.

Further, such a layer of organic polymer as abovementioned may then be coated with a silicate film by making use of the technology as mentioned in the 2nd category. It is also possible to form an organic coating of high hydrophilicity over a double-layered structure consisting of a base coat with high corrosion resistance and a uniform top coat with sufficient hydrophilicity. In this way, exposure of a hydrophilic layer former such as silica gel and water glass can be avoided thereby minimizing tool abrasion during subsequent working.

SUMMARY OF THE INVENTION

The present invention is characterized in that, at least one material from (A) and (B) is selected to prepare an aqueous solution, and such a solution is applied to aluminum, and dried.

(A): amphoteric polymer obtained by the copolymerization of monomer (I) which is represented by the empirical formula,

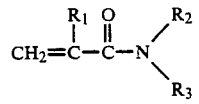

(I)

where $R_1$ represents H or $CH_3$ and $R_2$ and $R_3$ represent H, alkyl radical of $C_1$–$C_4$, benzyl radical or alkanol group of $C_2$–$C_3$— together with an unsaturated cationic monomer (II) and an unsaturated anionic monomer (III).

(B): amphoteric polymer obtained by the post treatment of homopolymer or copolymer of the abovementioned monomer (I). It may be desirable to include a water-soluble cross-linking agent (C) in the aqueous solution. In some cases, it may also be desirable to apply an aqueous water-glass solution over the above coatings and dry it to form a hydrophilic film.

DETAILED DESCRIPTION OF THE INVENTION

It is publicly-known that polymers of acrylamide (corresponding to the said general formula (I) where $R_1$, $R_2$ and $R_3$ are H) are of excellent hydrophilicity. However, such polymers having a linear structure, and being water soluble, are not suitable for forming a hydrophilic film on a heat exchanger. However, when an acrylamide is formed into an amphoteric polymer, or is cross-linked with cross-linking agent so as to achieve a network structure, it becomes water-insoluble and therefore usable as a coating former. Accordingly, the present invention can make use of a water-soluble cross-linking agent to provide the formed coating with water-insolubility. The coating remains durable without being washed away in running water and exhibits resistance to organic solvents such as trichloroethane which, depending on the case, may be used in a subsequent cold working process. In order to attain such excellent performance, it is necessary to either use amphoteric polymer (A) or (B) or to uniformly mix the water soluble acrylamide polymer with a water-soluble cross-linking agent to make the cross-linking reaction proceed sufficiently.

Further, where addition of chromic acid or a dichromate is made for the purpose of providing corrosion resistance to the aluminum surface, the polymer produced from the abovementioned monomers, (I), (II) and (III) has a sufficient mixing stability, so that it is possible to perform chromate conversion coating simultaneously with polymer film formation. Further the two treatments can yield a synergistic effect, providing superior surface quality.

As the water-soluble cross-linking agent (C) there may be employed those based on inorganic constituents or those based on organic constituents. Of the inorganic types, metal compounds capable of forming complex compounds with pollymer (A) or (B) are usable. As such compounds, those having coordination number more than 4 as listed in Table 1 are preferred. Amongst the compounds of Cr, Ti, Al and Zr, specifically effective are the compounds having particularly high water-solubility such as chromic acid, dichromates, di-isopropoxy-titanium-bis-acetylacetone, reaction product of lactic acid and titanium alcoholoxide, zirconyl nitrate, zirconyl acetate, zirconyl-ammonium carbonate, fluorozirconic acid and its salts and aluminum sulphate.

TABLE 1

| Coordination Number | Metal Ion | | | | |
|---|---|---|---|---|---|
| 2 | Cu(I) | Ag(I) | Hg(I) | Hg(II) | |
| 4 | Li(I) | Be(II) | B(III) | Zn(II) | Cd(II) |
| | Hg(II) | Al(III) | Co(II) | Ni(II) | Cu(II) |
| | Ag(II) | Au(III) | Pd(II) | Pt(II) | |
| 6 | Ca(II) | Sr(II) | Ba(II) | Ti(IV) | V(III) |
| | V(IV) | Cr(III) | Mn(II) | Mn(III) | Fe(II) |
| | Fe(III) | Co(II) | Co(III) | Ni(II) | Pd(IV) |
| | Pt(IV) | Cd(II) | Al(III) | Sc(III) | Y(III) |
| | Si(IV) | Sn(II) | Sn(IV) | Pb(II) | Pb(IV) |
| | Ru(III) | Rh(III) | Os(III) | Ir(III) | |
| | | | | Lanthanide | |
| 8 | Zr(IV) | Hf(IV) | Mo(IV) | W(IV) | |
| | U(IV) | Actinide | | | |

As water-soluble organic cross-linking agents, water-soluble blocked polyisocyanate and/or water-soluble compounds of polymethylol, polyglycidyl, polyaziridyl are usable. To mention them in concrete terms, they are polyisocyanate blocked with $NaHSO_3$ (e.g. ELASTRON: product of DAI-ICHI KOGYO SEIYAKU CO., LTD.), methylol melamine, methylol urea, methyloled polyacrylamide, diglycidyl-ether of polyethylene oxide and diaziridyl-polyethylene oxide.

Of course, combined use of organic and inorganic agents is also possible, for example, compounds of Cr, Ti, Al and Zr as inorganic water-soluble compounds and blocked polyisocyanate, polymethylol/polyglycidyl/polyaziridyl compounds as organic water-soluble compounds.

The appropriate amount of cross-linking agent differs depending on the specific agent employed. It also differs depending whether the polymer is used as a thicker base coat primarily aiming at the corrosion resistance or is used as a thinner monolayer type coating. Still it may be said in general that the amount of cross-linking agent per 100 weight parts of polymer used is 1–400 weight parts, preferably 5–200 weight parts.

The amphoteric polymer which is used in the present invention has the empirical generic formula: $(I)_l$—$(II)_m$—$(III)_n$—$(IV)_o$, in which l, m, n and o are mole % in the copolymer, (II) is a cationic monomer, (III) is an anionic monomer, $l>40$, $m=1+59$, $n=1-59$, $0\leqq o<30$ and $l+m+n+o=100$.

(I) is as described previously and preferably is acrylamide, methacrylamide, N-methylacrylamide, or N-dimethylacrylamide and (IV) is a nonionic monomer capable of copolymerization and examples are:

2-hydroxy methacrylate
Diacetone acrylamide
Methylol acrylamide
Acrylol morpholine
Acrylonitrile
Methacrylic ester
Styrene
Vinyl acetate (II) has the general formula:

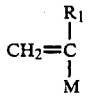

where M is one of the following:

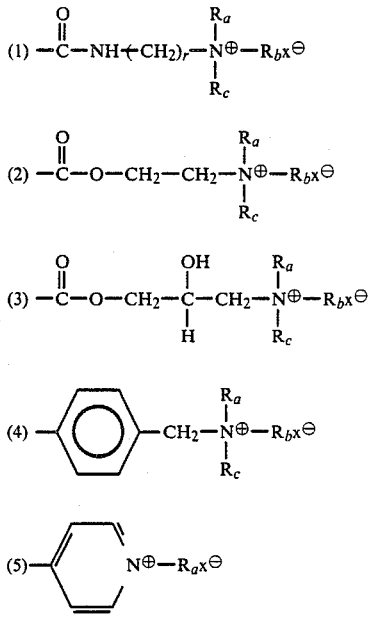

Wherein $R_a$, $R_b$, $R_c$=H, alkyl, hydroxyalkyl, phenyl, benzyl.

r=1 to 3

$x^{\ominus}$=acid radical of inorganic or organic acid.

(III) has the general formula:

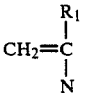

or its copolymer with an unsaturated compound having carbonic group of maleic anhydride, itaconic acid or sulpho (phospho) group. where N is one of the following:

(a) —COOH (or its salt)

(b) —$SO_3H$ (or its salt)

(c) 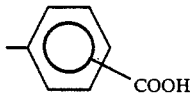 (or its salt)

-continued (d) 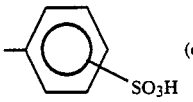 (or its salt)

(e) $-\overset{O}{\overset{\|}{C}}-NH-CH_2-SO_3H$ (or its salt)

(f) $-\overset{O}{\overset{\|}{C}}-NH-\overset{CH_3}{\underset{CH_3}{\overset{|}{\underset{|}{C}}}}-CH_2-SO_3H$ (or its salt)

(g) $CH_2=\overset{CH_3}{\overset{|}{C}}-COO-CH_2-\overset{H\ (or\ CH_3)}{\overset{|}{CH}}-O-\overset{OH}{\overset{/}{\underset{OH}{\underset{|}{P}}}}=O$ (or its salt)

The polymer post-treatment referred to in (B) may be accomplished as follows:

(i) Conversion of amide radical to carboxyl radical by hydrolysis.

(ii) Conversion of amide radical to $$-CONH-CH_2-N\begin{matrix}R_4\\R_5\end{matrix}$$

by Mannich reaction with $$HN\begin{matrix}R_4\\R_5\end{matrix}$$

and formaldehyde wherein $R_4$, $R_5$ are alkyl radical of $C_1$–$C_4$, alkanol group of $C_2$–$C_3$ or benzyl.

(iii) Introduction of $-CONH-R_6-NH_2$ by the Hofmann reaction between side-chain ester radical and alkylenediamine ($H_2N-R_6-NH_2$), wherein $R_6$ is alkylene radical of $C_2$–$C_6$.

(iv) Conversion to quaternary amino compound, by alkylating the amino radical of the reaction product of (ii) or (iii).

The coating may be applied by dipping, spraying, brushing, roll coating, flow coating etc., adjusting the molecular weight to less than 2,000,000, preferably 1,000,000, is advisable in order to suppress striginess of the polymer. As to the selection of the concentration and viscosity, appropriate levels are established according to the coating method to be used and the required paint film thickness. As to the film thickness for the aluminum heat exchanger, in order to improve the thermal efficiency and to be capable of contributing to the corrosion resistance, about 0.1 to 10 microns, preferably 0.2 to 2 microns is advisable.

As to the coating of aluminum, which has been previously degreased, either direct coating or coating after; Boehmite treatment, or chemical conversion treatment like chromating as available. In the cast of direct coating, however, addition of chromic acid or dichromate is particularly effective.

As to other agents such as rust preventive, filler, pigment, surface-active agent, antifoam, levelling-effective agent, antibacterial/fungal agent etc., addition is possible to the extent that it does not impair the performance of the coating as intended in the present invention.

As described earlier, water is used as the paint solvent, but for the purpose of accelerating the drying and improving the paint film quality, the combination use of water-soluble solvent, such as alcohol, ketone, cellosolve is also possibly available though not required in the present invention.

The stability of the coating solution varies depending on the composition. Use of the amphoteric polymer in the vicinity of the isoelectric point should be avoided as the polymer undergoes deposition/separation there. In general, it is preferable for the cationic polymer to be used on the neutral—acidic side and for anionic polymer to be used on the neutral—alkaline side.

If a cross-linking agent is used, in the case metallic compound except special compounds such as zironylammonium carbonate, acidic side is generally preferable, while, in the case of organic cross-linking agent, the acidic side is preferable for isocyanate type, and the alkaline side for methylol, glycidyl and aziridyl types.

Where a water glass solution is also applied, water glass having a $SiO_2/M_2O$ ratio (M indicates Na, K or Li) of 2 to 5 is generally used, on which, however, no specific limit is placed. The concentration of the aqueous silicate solution is without restriction as to range from the performance aspect of hydrophilic surface.

As to the amount of aqueous silicate solution, it is desirable to design the process so as to form a silicate coating of 0.1–5 μm thickness after heating/drying. A thickness less than 0.1 μm cannot yield sufficiently durable hydrophilicity, while over 5 μm often gives rise to insufficient hardening (non-water-solubilization) or development of fissures on the coating which may affect the performance of the heat exchanger. Addition of a polymer, e.g. water-soluble acrylate, to the water glass solution is effective for preventing fissure development.

As to heating/drying of the silicate, selection should be made within the range: 100°–250° C. and 20 sec.–min., employing shorter time at higher temperature.

The present invention has made it possible to use an amphoteric polymer for coating aluminum, since the dried film becomes water-insoluble. Further it has been made known that, besides the hydrophilicity provided by polyacrylamide, which is common knowledge, excellent corrosion resistance can be thereby obtained.

In the following, the present invention is explained in more detail by citing practical examples.

The test method used in the Examples is as follows:

Contact angle

A water droplet of 1–2 mm diameter was placed on a coated surface and its contact angle was measured by face contact angle measuring apparatus, Model CA-P, product of Kyowa Kaimenkagaku Co., Ltd. Both a freshly coated surface and one subjected to marine water immersion for 1 week were tested.

Corrosion resistance

In accordance with JIS Z-2371 for salt spray test, the time for white rust development on 5% surface area was indicated.

Running water resistance

The test piece was immersed in running water at room temperature for 8 hr. and then dried at 80° C. for 16 hr. After repeating this cycle 5 times, the contact angle of water was measured.

EXAMPLE 1

Aluminum sheet pretreated with chromic chromate was coated with an aqueous solution containing 10 g/l of a polymer which was obtained by dimethylaminomethylation of the co-polymer of 95 mol % acrylamide and 5 mol % acrylic acid to the extent of about 11%. The work was put in an electric oven of 250° C. and heat-dried. The coating weight thus obtained was 0.3 g/m$^2$.

EXAMPLES 2 AND 3

In the same way as in Example 1 but with varied conditions. The results are indicated in Table 3.

TABLE 2

| Example No. | Conversion Coating | Polymer | | Examples: Inorganic cross-linking agent | Organic cross-linking agent | Others | Top Coat |
|---|---|---|---|---|---|---|---|
| 1 | Chromic chromate | Copolymer of acrylamide (95%) and acrylic acid (5%) | Dimethylamine Formaldehyde | — | — | — | — |
| | | Dimethylamino methylation of amide to about 11 mol % by reaction, 10 g/l | | | | | |
| 2 | Chromic phosphate | Acrylamide (40%) Acrylic acid (10%) 2-hydroxy-3-methacryloxy propyl trimethyl ammonium chloride (40%) 2-hydroxyethyl acrylate (10%) | Copolymer 40 g/l | — | ELASTRON A-42 10 g/l | Phosphoric acid 30 g/l | No. 3 waterglass (0.5 μm) |
| 3 | Without | Acrylamide (60%) Sodium styrene-sulfonate (30%) Dimethyl-aminoethyl acrylate (10%) | Copolymer 20 g/l | Anhydrous chromic acid 4 g/l | — | — | — |

TABLE 3

| Example No. | Contact angle (degree): Incipient period | After running water test | Corrosion Resistance (hr) |
|---|---|---|---|
| 1 | 15–20° | 35–45° | >240 |
| 2 | <5° | 20–25° | >240 |
| 3 | 20–25° | 30–40° | >216 |

(Effect of the present invention)

Coating with superior hydrophilicity and corrosion resistance can be obtained.

What is claimed is:

1. A method for forming a hydrophilic coating on an aluminum surface comprising contacting said surface with an aqueous solution comprising at least one polymer or copolymer selected from the group consisting of (1) an amphoteric copolymer having the empirical formula $(I)_l-(II)_m-(III)_n-(IV)_o$ in which (I) is

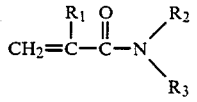

wherein $R_1$ represents H or $CH_3$ and $R_2$ and $R_3$ represent H, alkyl radical of $C_1$–$C_4$, benzyl radical or alkanol group of $C_2$–$C_3$ (II) is an unsaturated cationic monomer;

(III) is an unsaturated anionic monomer;

(IV) is a nonionic monomer capable of copolymerization;

and wherein l, m, n and o represent mole % and $l+m+n+o=100$ $l \geqq 40$; $m=1$–$59$; $n=1$–$59$ and $o=0$–$30$ and (2) an amphoteric polymer obtained by the reaction of a homopolymer or copolymer of monomer (I) by (i) Conversion of amide radical to carboxyl radical by hydrolysis, (ii) Conversion of amide radical to

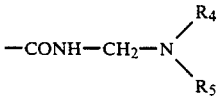

by Mannich reaction with

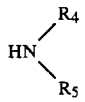

and formaldehyde wherein $R_4$, $R_5$ are alkyl radical of $C_1$–$C_4$, alkanol group of $C_2$–$C_3$ or benzyl, (iii) Introduction of —CONH—$R_6$—$NH_2$ by the Hofmann reaction between side-chain ester radical and alkylenediamine ($H_2N$—$R_6$—$NH_2$), wherein $R_6$ is alkylene radical of $C_2$–$C_6$, (iv) Conversion to quaternary amino compound, by alkylating the amino radical of the reaction product of (ii) or (iii), and thereafter drying the solution on the surface.

2. The method of claim 1 wherein monomer (II) has the general formula

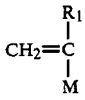

wherein M is one of the following:

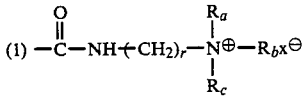

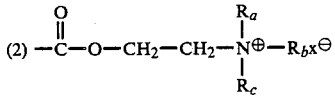

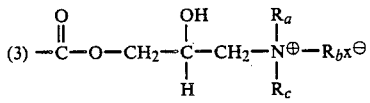

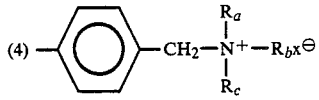

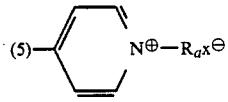

Wherein $R_a$, $R_b$, $R_c$=H, alkyl, hydroxyalkyl, phenyl, benzyl, r=1 to 3

$x^{\ominus}$=acid radical of inorganic or organic acid.

3. The method of claim 1 wherein monomer (III) has the general formula

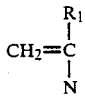

or its copolymer with an unsaturated compound having carbonic group of maleic anhydride, itaconic acid or sulpho (phospho) group, where N is one of the following:

(a) —COOH (or its salt)

(b) —$SO_3H$ (or its salt)

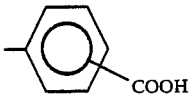

(or its salt)

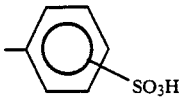

(or its salt)

(e) —C(=O)—NH—$CH_2$—$SO_3H$ (or its salt)

(f) —C(=O)—NH—C($CH_3$)$_2$—$CH_2$—$SO_3H$ (or its salt)

(g) $CH_2$=C($CH_3$)—COO—$CH_2$—CH(H (or $CH_3$))—O—P(OH)(=O)—OH (or its salt).

4. The method of claim 1 wherein the monomer (IV) is at least one monomer select from the group consisting of 2-hydroxy methacrylate, diacetone acrylamide, methylol acrylamide, acrylol morpholine, acrylonitrile, methacrylic ester, styrene and vinyl acetate.

5. The method of claim 1 wherein the aqueous polymer solution additionally comprises a cross-linking agent.

6. The method of claim 5 wherein the cross-linking agent comprises at least one metal ion having a coordination number of more than 4.

7. The method of claim 5 wherein the cross-linking agent comprises at least one water soluble organic compound selected from blocked polyisocyanates, polymethylol, polyglycidyl and polyaziridyl compounds.

8. The method of claim 7 wherein the organic compound is selected from polyisocyanate blocked with $NaHSO_3$, methylolmelamine, methylolurea, methyloled polyacrylamide, diglycidylether of polyethyleneoxide, and diaziridyl-polyethyleneoxide.

9. The method of claims 1–8 comprising the additional subsequent steps of applying a water-glass solution to the dried organic coating and drying it on the surface.

* * * * *